US008413832B2

(12) United States Patent
Mazurkiewicz et al.

(10) Patent No.: US 8,413,832 B2
(45) Date of Patent: Apr. 9, 2013

(54) CLOSURE WITH TAMPER-EVIDENT FEATURE

(75) Inventors: Timothy M. Mazurkiewicz, Milwaukee, WI (US); Charles E. Roberts, Eagle, WI (US); Kelly A. Smith, East Troy, WI (US); Albert D. Bailey, Jr., Kenosha, WI (US); John Wisniewski, Wauwatosa, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 13/262,911

(22) PCT Filed: Mar. 3, 2011

(86) PCT No.: PCT/US2011/026950
§ 371 (c)(1),
(2), (4) Date: Oct. 4, 2011

(87) PCT Pub. No.: WO2012/118502

PCT Pub. Date: Sep. 7, 2012

(65) Prior Publication Data

US 2012/0279966 A1 Nov. 8, 2012

(51) Int. Cl.
*B65D 41/32* (2006.01)
*B65D 51/04* (2006.01)

(52) U.S. Cl.
USPC ..... 220/266; 215/253; 215/235; 215/305; 222/153.06; 222/556; 220/254.3

(58) Field of Classification Search ..... 220/266, 220/254.3, 254.5, 257.1, 259.1, 285, 780; 222/153.06, 556; 215/47, 235, 237, 253
See application file for complete search history.

(56) References Cited

U.S. PATENT DOCUMENTS

| | | | | |
|---|---|---|---|---|
| 4,444,326 | A * | 4/1984 | Musel | 215/209 |
| 5,579,957 | A * | 12/1996 | Gentile et al. | 222/153.14 |
| 5,860,543 | A * | 1/1999 | Decelles | 215/209 |
| 5,875,907 | A | 3/1999 | Lay | |
| 6,003,712 | A | 12/1999 | Mogard et al. | |
| 6,170,710 | B1 * | 1/2001 | Suffa | 222/153.06 |
| 6,269,986 | B1 | 8/2001 | Gross | |
| 7,044,317 | B2 | 5/2006 | Smith et al. | |
| 2002/0175137 | A1 * | 11/2002 | Rousselet | 215/235 |
| 2009/0159552 | A1 | 6/2009 | Cano-Pey et al. | |

FOREIGN PATENT DOCUMENTS

| | | |
|---|---|---|
| DE | 199 62 716.9 | 12/1999 |
| DE | 100 25 265 A1 | 7/2001 |
| DE | 200 09 203 U1 | 7/2001 |
| WO | 01/46032 A2 | 6/2001 |
| WO | 2004/094239 A2 | 11/2004 |

OTHER PUBLICATIONS

International Search Report and the Written Opinion mailed May 5, 2011 in the International Application No. PCT/US2011/026950 of which the instant patent application is the U.S. National Phase.
English translation of German Application Serial No. 100 25 265 A1 published Jul. 19, 2011.

* cited by examiner

*Primary Examiner* — Anthony Stashick
*Assistant Examiner* — James N Smalley
(74) *Attorney, Agent, or Firm* — Wood, Phillips, Katz, Clark & Mortimer

(57) ABSTRACT

A tamper-evident closure (40) is provided for a container. In one particular embodiment, the closure (40) has a body (42) and a hinged lid (44), and has the following additional features as next described. A tamper-indicating tab (120) is connected to the lid (44) by a frangible junction (130). A pressing member (150) is connected to the closure body (42) for movement from an initial unactuated configuration and to an inwardly deformed, actuated configuration. A post (170) is provided on either the pressing member (150) or tab (120), and a slot (140) is defined in the other of the pressing member (150) and tab (120), wherein the slot (140) non-releasably receives the post (170) when the lid (44) is first closed. The closure body (42) also has an inwardly located retention wall (160) defining an aperture (164). When the pressing member (150) is pressed inwardly, the frangible junction (130) is broken to allow the lid (44) to be lifted, and an end portion of the post (170) is non-releasably received in the retention wall aperture (164).

15 Claims, 12 Drawing Sheets

CLOSURE WITH TAMPER-EVIDENT FEATURE

TECHNICAL FIELD

The present invention relates to a tamper-indicating or tamper-evident closure for a container wherein the closure must be altered in some fashion to obtain access to the container contents, the alteration being evidence that the container has been previously opened or at least that the tamper-evident feature has been altered.

BACKGROUND OF THE INVENTION AND TECHNICAL PROBLEMS POSED BY THE PRIOR ART

A variety of container closures have been developed or proposed wherein an initial opening of a lid provides visual evidence of such an occurrence—even after the lid has been subsequently closed.

U.S. Pat. Nos. 5,875,907 and 6,269,986 each discloses a closure that is adapted for mounting on a container and that has a body and a lid. The closure includes a tamper-indicating member connected to the body of the closure. The tamper-indicating member is also connected along a frangible junction to the lid of the closure. When the tamper-indicating member is depressed, the frangible junction is broken to provide an indication that the closure may have been previously opened.

While the above-discussed type of closure can function well for the purposes for which it has been designed, the inventors of the present invention have discovered that it would be desirable to provide an improved tamper-evident closure which could (1) accommodate (a) convenient molding of the closure with the lid in an initially open position, and (b) subsequent closing of the lid by the manufacturer with a simple and easy manipulation to place the closure in its fully closed, tamper-indicating, ready condition for eventual installation on a container and delivery to a user, (2) readily incorporate certain types of lids and/or flow control elements, (3) incorporate the tamper-evident features which could optionally be designed to blend in with, or enhance, the cosmetic appearance of the closure, prior to the initial opening by the consumer, (4) optionally be designed to be molded as one piece, including the lid, body, and tamper-indicating features, and (5) be initially opened relatively easily by the user.

The inventors have also discovered that it would be desirable if, after the tamper-indicating feature of such an improved closure has been initially breached, the closure presented a very clear indication of that breach, without the creation of a separate scrap piece requiring disposal.

The inventors of the present invention have discovered how to construct such an improved tamper-evident or tamper-indicating closure which can accommodate designs having one or more of the above-discussed benefits and features.

SUMMARY

According to some aspects of the present invention, an improved tamper-evident closure is provided for being mounted to, or formed as a unitary part of, a container that has an opening to the container interior where a product may be stored.

The closure has a body that is either (1) a separate structure for being attached to the container at the opening, or (2) a structure formed as a unitary portion of the container at the opening. The body has at least one dispensing orifice for communicating with the container opening.

The closure also has a lid that (1) is connected to the body with a hinge and movable between (i) a closed position occluding the dispensing orifice, and (ii) an open position spaced from the dispensing orifice, and (2) has a lifting region against which a force can be applied by the user to lift the lid away from the closed position.

The closure also has a tamper-evident tab that has a proximal end frangibly connected to the lid with a frangible junction.

The closure also has a pressing member that (1) is connected to the body in an initial unactuated configuration, and (2) can be subsequently pressed laterally inwardly to (i) deform to an actuated configuration, and (ii) force the tamper-evident tab laterally inwardly a distance sufficient to break the frangible junction to separate the tamper-evident tab from the lid.

A first receiver is defined on either the tamper-evident tab or the pressing member.

A first connector is defined on the other of the tamper-evident tab and the pressing member for being received in the first receiver to establish a non-releasable engagement between the tamper-evident tab and the pressing member when the lid is initially moved to the closed position for the first time (e.g., by the manufacturer of the lid).

A second receiver is defined on the body.

A second connector is defined on the first connector for being received in the second receiver when the pressing member is pressed laterally inwardly from the unactuated configuration to the actuated configuration to establish a non-releasable arrangement between the pressing member and the second receiver while the pressing member is in the actuated configuration to indicate that the tamper-evident tab has been broken from the lid.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

Figure 1:
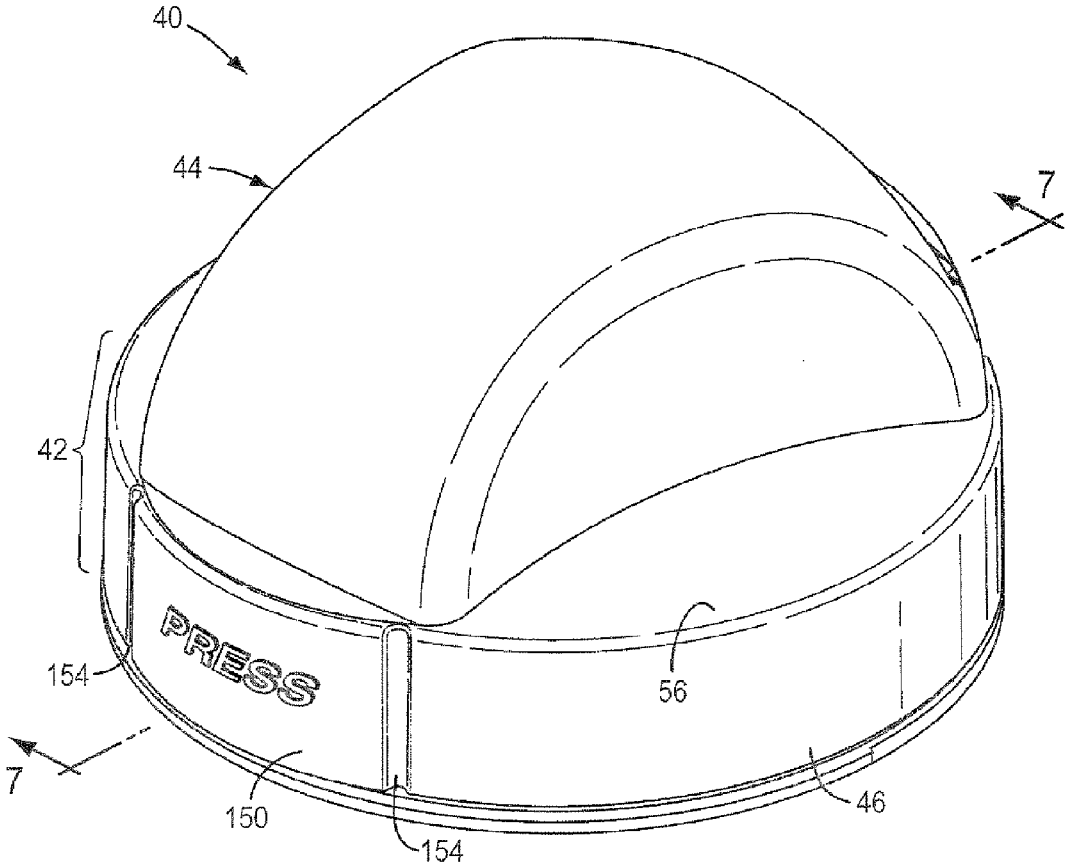
FIG. 1 is a top isometric view of an embodiment of a tamper-evident dispensing closure of the present invention in the form of a closure that is manufactured separately from a container (not shown), and wherein the closure is shown in the closed condition as initially established by the manufacturer prior to the closure being opened for the first time.

While this invention is susceptible of embodiment in many different forms, the accompanying drawings illustrate only one specific form as an example of the invention that is presently believed to be the best mode. The specification describes the one illustrated embodiment, and also describes various alternate embodiments or variations. The invention is not intended to be limited to the embodiments so described, and the scope of the invention will be pointed out in the appended claims.

For ease of description, the illustrated embodiment of the closure that incorporates aspects of this invention is described in particular orientations, and terms such as upper, lower, horizontal, etc., are used with reference to these orientations. It will be understood, however, that the closure may be manufactured, stored, and used in orientations other than the ones described.

With reference to the figures, the closure is identified generally in some of those figures by reference number 40. The closure 40 is adapted to be disposed on a container (not illustrated) which may have a conventional mouth or opening formed by a neck or other suitable structure.

Although the container, per se, does not form a part of the broadest aspects of the present invention, per se, it will be appreciated that at least a body or base portion of the closure 40 optionally may be provided as a unitary portion, or extension, of the top of the container. However, in the embodiment illustrated, the closure 40 is a separate article or unit (e.g., a dispensing closure 40) which is adapted to be removably, or non-removably, installed on a previously manufactured container that has an opening to the container interior.

The illustrated embodiment of the closure 40 is adapted to be used with a container having an opening to provide access to the container interior and to a product contained therein. The closure 40 can be used to dispense many types of materials, including, but not limited to, relatively low or high viscosity liquids, creams, gels, lotions, suspensions, mixtures, discrete items (including particles), etc. (such as a material constituting a food product, a beverage product, a personal care product, an industrial or household cleaning product, or other compositions of matter (e.g., compositions for use in activities involving manufacturing, commercial or household maintenance, construction, agriculture, medical treatment, military operations, etc.)).

The container with which the closure 40 may be used could be a squeezable container for a liquid product, and such a container could have a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to pressurize the container interior at selected times with a piston or other pressurizing system, or to reduce the exterior ambient pressure so as to suck the material out through the open closure.

It is presently contemplated that many applications employing the closure 40 will conveniently be realized by molding the closure 40 from suitable thermoplastic material or materials. In the preferred embodiment illustrated, the closure could be molded from a suitable thermoplastic material, such as, but not limited to, polypropylene.

Figure 2:
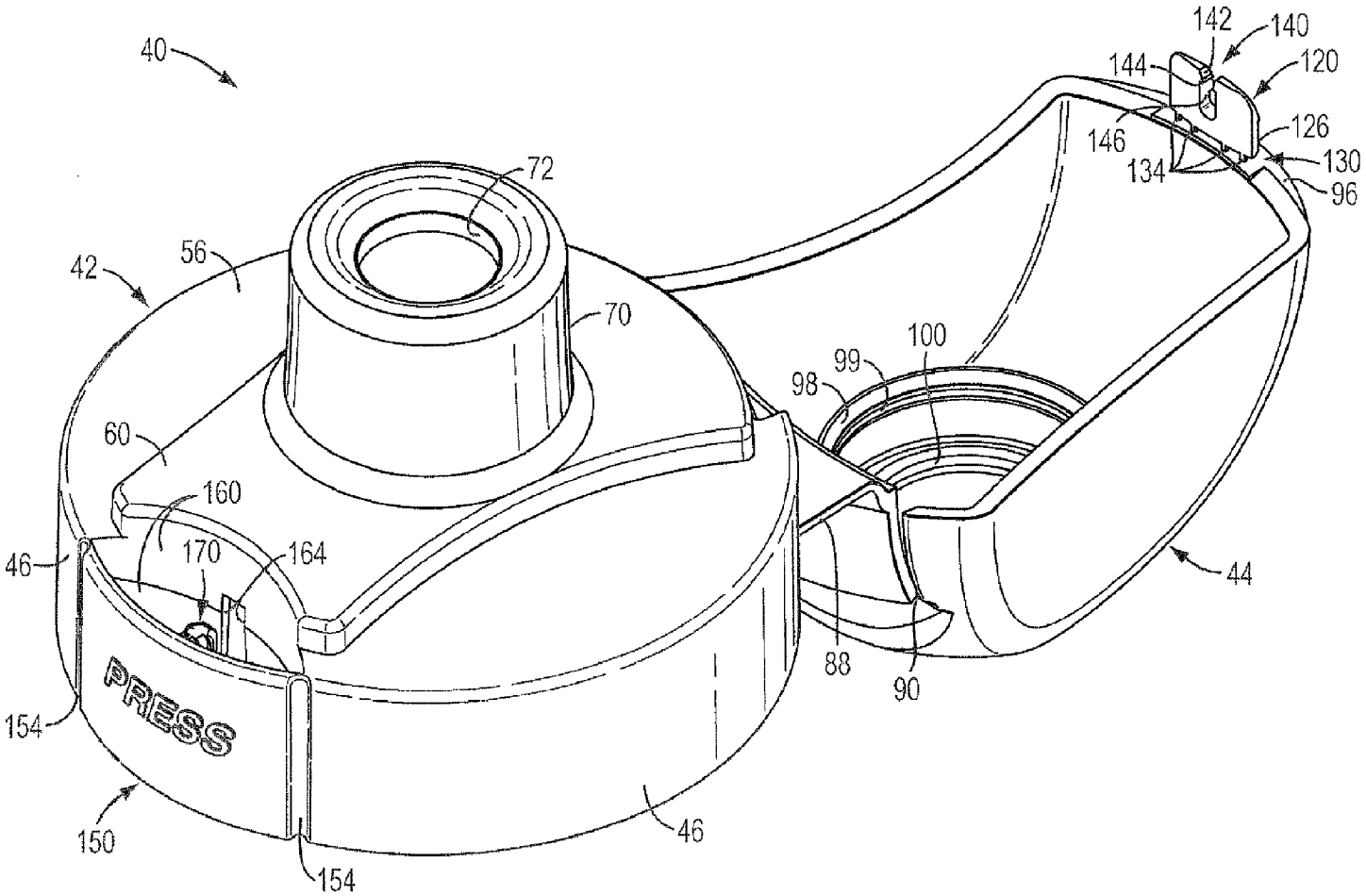
FIG. 2 is an isometric view similar to FIG. 1, but FIG. 2 shows the closure in the "as-molded" condition before the lid has first been closed for the first time by the manufacturer.

As can be seen in FIG. 2, the closure 40 includes a base or body 42 and a lid 44 mounted on the body 42. Throughout this specification, the terms "base" and "body" will be used interchangeably. The base or body 42 includes an exterior skirt 46 (FIG. 2) and an internal collar 48 (FIG. 6) which has a conventional, internal, female thread 50 for engaging a suitable cooperating external thread on the container (not shown), so as to secure the closure base or body 42 to the container. Alternatively, a snap-fit bead connection system could be used. On another optional design (not illustrated), the closure internal collar 48 could be omitted altogether, and the exterior skirt 46 could be configured and sized for mounting directly on the container.

Figure 7:
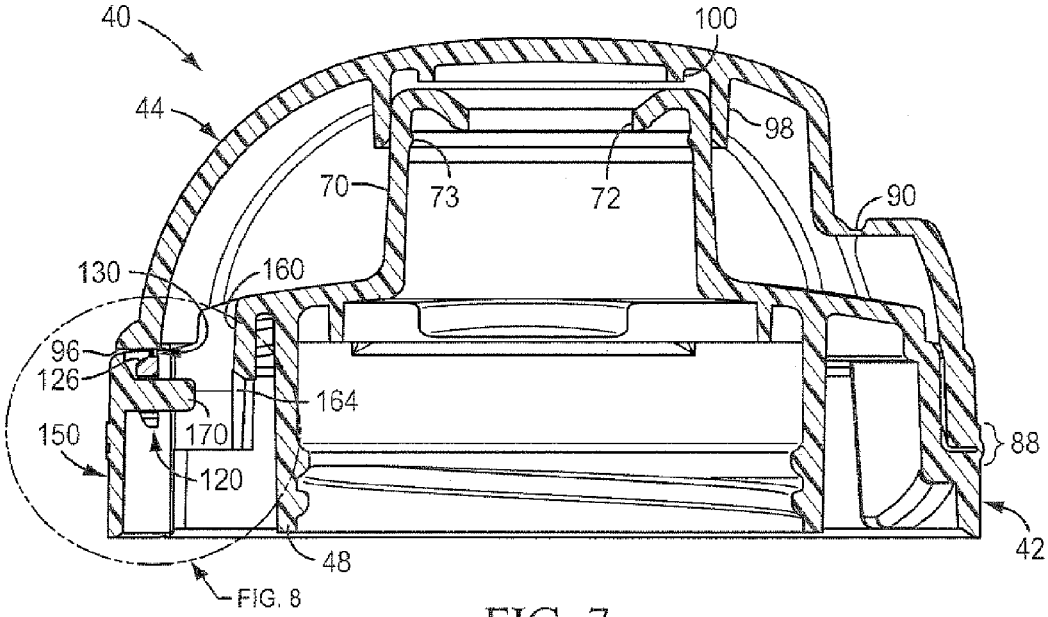
FIG. 7 is a cross-sectional view of the closure shown in FIG. 1 taken generally along the plane 7-7 in FIG. 1.

At the top of the closure base extension skirt 46, the skirt 46 joins a transverse deck 56 (FIG. 2). As can be seen in FIG. 2, the deck 56 includes a raised platform 60 that is enclosed by the lid 44 when the lid 44 is closed (FIG. 7). The particular shapes and sizes of the skirt 46, deck 56, and platform 60 are not critical to the invention.

Figure 6:
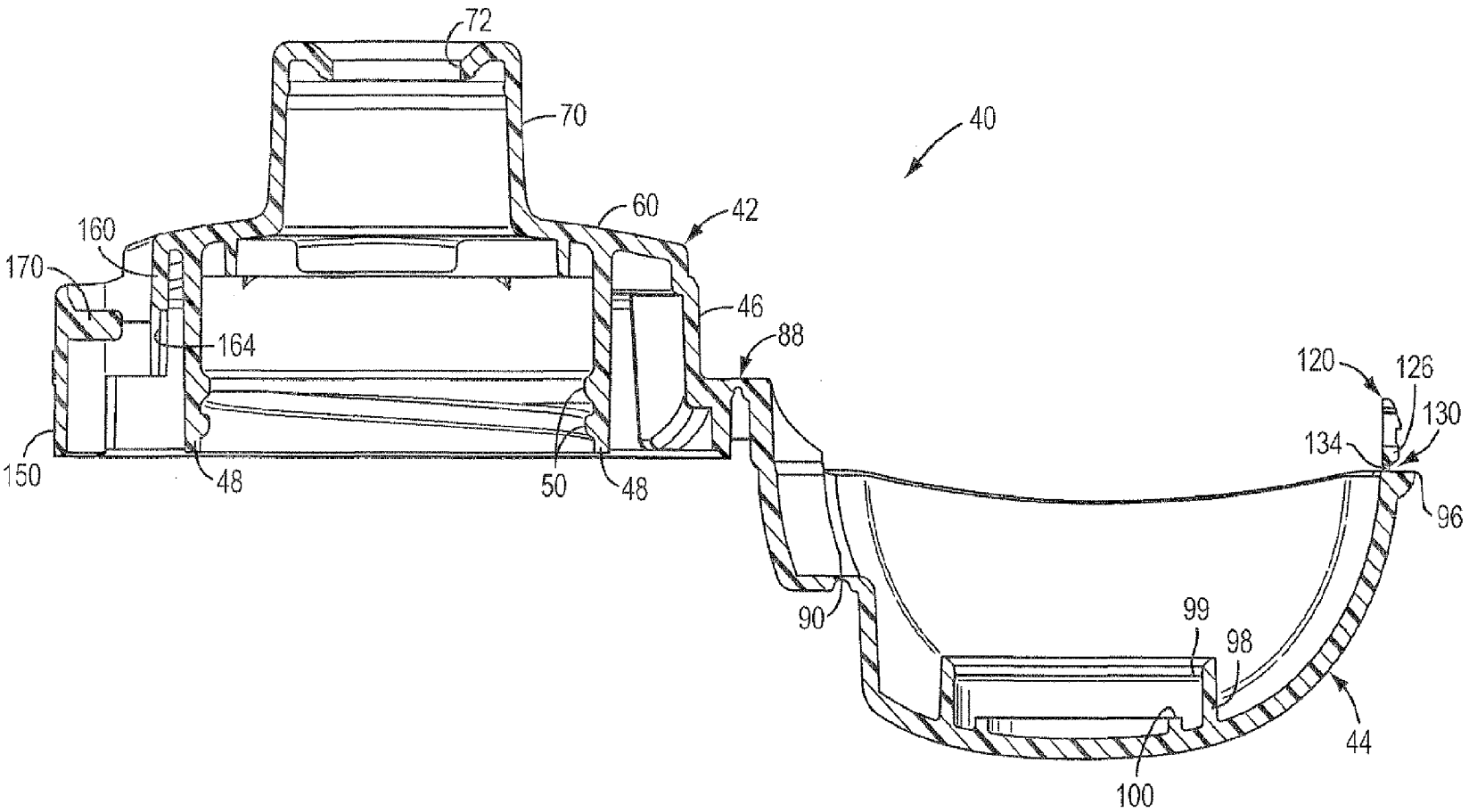
FIG. 6 is a cross-sectional view taken generally along the plane 6-6 in FIG. 3.

With reference to FIGS. 2 and 6, a spout 70 projects upwardly from the closure body deck platform 60 to define a discharge aperture 72. The particular shape of the spout 70, or even the presence or absence of the spout 70, per se, forms no necessary part of the present invention.

The platform 60 has (but need not have) a downwardly extending, annular, internal seal structure 84 (FIG. 6) which is received against the inner edge of the container opening so as to provide a leak-tight seal between the closure 40 and the container when the closure 40 is installed on the container (not shown). In the embodiment illustrated, the sides of the closure body raised platform 60 between a front of the closure 40 and the rear of the closure 40 have an inwardly curving configuration, and the sides of the lid 44 have a similar inwardly curving configuration, so that when the lid 44 is closed (FIG. 1), the sides of the lid 44 are located adjacent the sides of the closure body raised platform 60. The particular shapes of the platform 60 and lid 44 are not critical to the present invention. Indeed, the platform 60, per se, could be omitted altogether.

In the preferred embodiment, the closure a lid 44 (FIGS. 2, 3, and 6) is connected to the closure body skirt 46 with a primary snap hinge 88. The adjacent wall of the lid 44 preferably includes a secondary film hinge 90.

Figure 3:
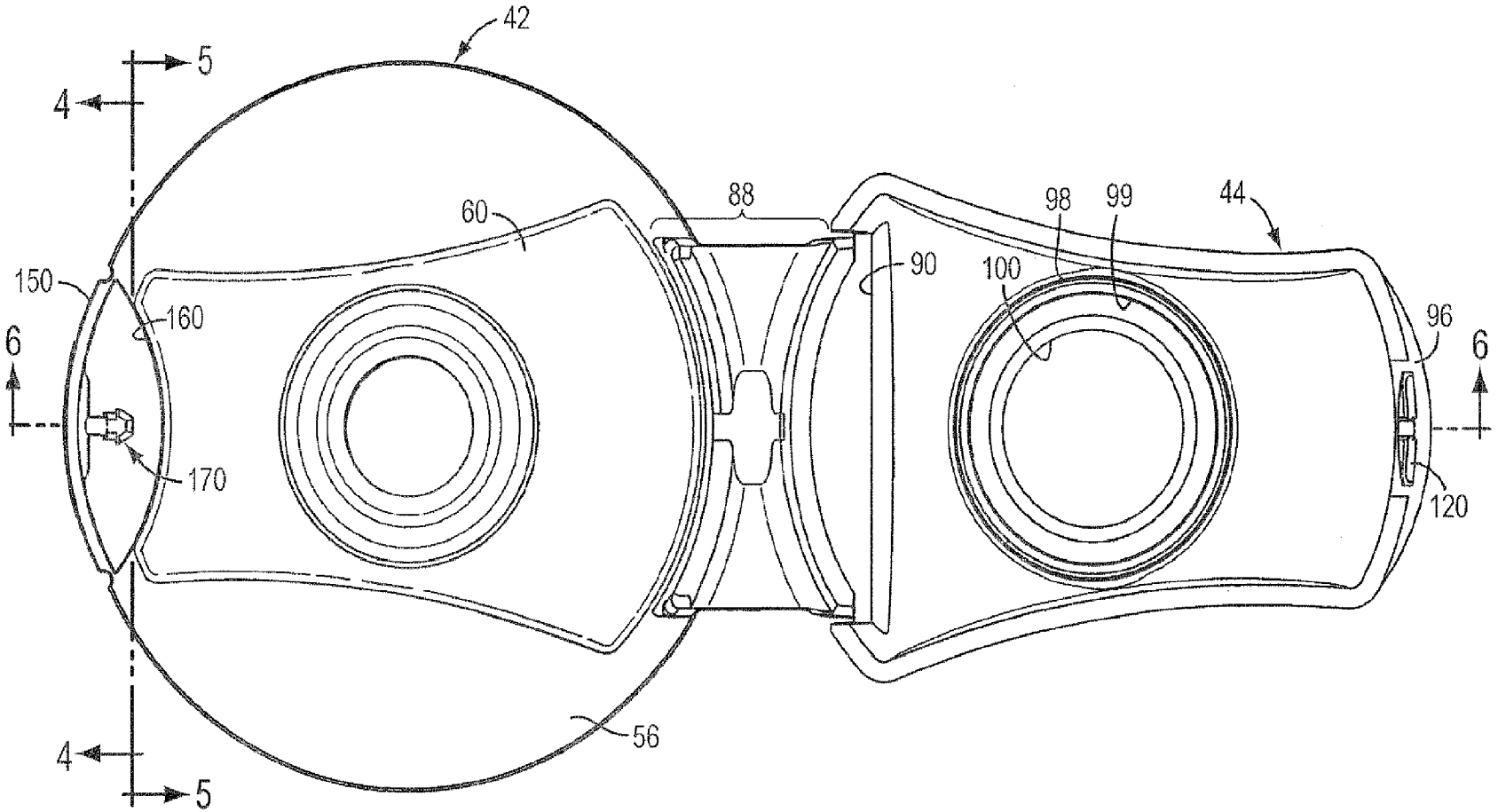
FIG. 3 is a plan view of the as-molded closure shown in FIG. 2.
Figure 4:
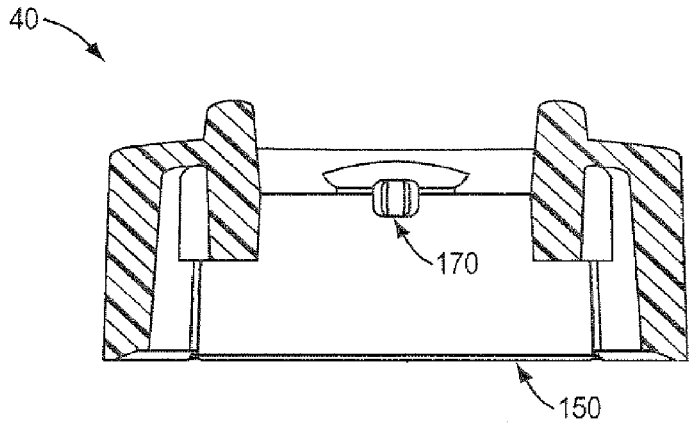
FIG. 4 is an enlarged cross-sectional view taken generally along the plane 4-4 in FIG. 3.

As can be seen in FIGS. 2, 3 and 6, the lid front end includes a lift tab 96 which projects outwardly from the front of the lid 44. Extending from the underside of the lid 44 is a projecting, annular collar 98 (FIG. 6) having an internal seal bead 99. Within the collar 98 there is an annular ring 100 which may serve as a rigidifying feature and/or which could be extended sufficiently to sealingly engage the top end of the closure body spout 70 when the lid is closed (FIG. 7). In FIG. 7, the bottom end of the ring 100 is shown terminating above, and not sealingly engaging, the top end of the closure body spout 70.

The lid primary snap-hinge 88 (FIG. 3) and secondary film hinge 90 (FIG. 3) employ conventional designs, the detailed structure and operation of which form no part of the present invention. If desired, the closure 40 could be configured to have only one hinge, for example, the snap hinge 88. However, in the embodiment shown in FIG. 6, wherein the primary hinge connection at the closure body 42 is located relatively low on the body 42, and wherein the depth or height of the lid 44 is relatively great, the provision of the secondary film hinge 90 provides enhanced operation for accommodating opening and closing over the upwardly projecting closure body spout 70.

In alternative embodiments (not illustrated), the hinge structures other than those illustrated could be employed instead. For example, the closure of the present invention could employ other hinge structures such as a tether, strap, etc. The detailed design and operation of such alternate hinge structures form no part of the present invention.

When the closure lid 44 is closed, then as can be seen in FIG. 7, the annular collar 98 is received on the exterior cylindrical surface of the spout 70 in sealing engagement. The annular collar seal bead 99, which is visible in FIG. 6, is so small that it is not visible in FIG. 7, but the bead 99 nevertheless aids in forming a leak-tight seal. In an alternate design (not illustrated), the collar 98 could be omitted, and the orifice 72 could instead be sealed by a spud extending from the lid 44 into the orifice 72 against the inner cylindrical surface of the spout 70.

The closure body 42 and closure lid 44 incorporate tamper-evident features. In particular, the closure lid 44 includes a tamper-evident tab 120 (FIG. 2). The tab 120 has a proximal end 126 (FIGS. 2 and 6) which is frangibly connected to the lid 44 with a frangible connection or junction 130 (FIGS. 2 and 6). The frangible connection or junction 130 is defined by a reduced cross-sectional thickness of material in the preferred embodiment as can be seen in FIG. 6. More preferably, the frangible junction 130 includes a plurality of spaced-apart frangible bridges 134 as shown in FIG. 2, and each frangible bridge 134 has a reduced cross-sectional thickness compared to the tamper-evident tab proximal end 126 and compared to the portion of the lid 44 from which the frangible bridges 134 extend. The frangible bridges 134 could have shapes other than that illustrated.

The tab 120 defines a slot 140 (FIG. 2). The portion of the tab 120 with its slot 140 functions as a "first receiver" to receive an extending part of the closure body 42 described in detail hereinafter. The slot 140 is open downwardly (when the lid 44 is in the closed position on the closure 40 on an upright container), and the slot 140 extends downwardly to the distal end of the tab 120. The distal end of the slot 140 flares outwardly at 142 (FIG. 2) and is wider than a portion of the slot 140 further inwardly toward the tab proximal end 126. The slot 140 defines a decreased or minimum width region at 144 (FIG. 2) inwardly from the distal end of the tab 120. The slot 140 becomes wider inwardly of the minimum width location 144 to define an increased width recess 146 (FIG. 2). The configuration of the slot 140 functions to receive and retain a feature of the closure body 42 described in detail hereinafter.

Figure 9:
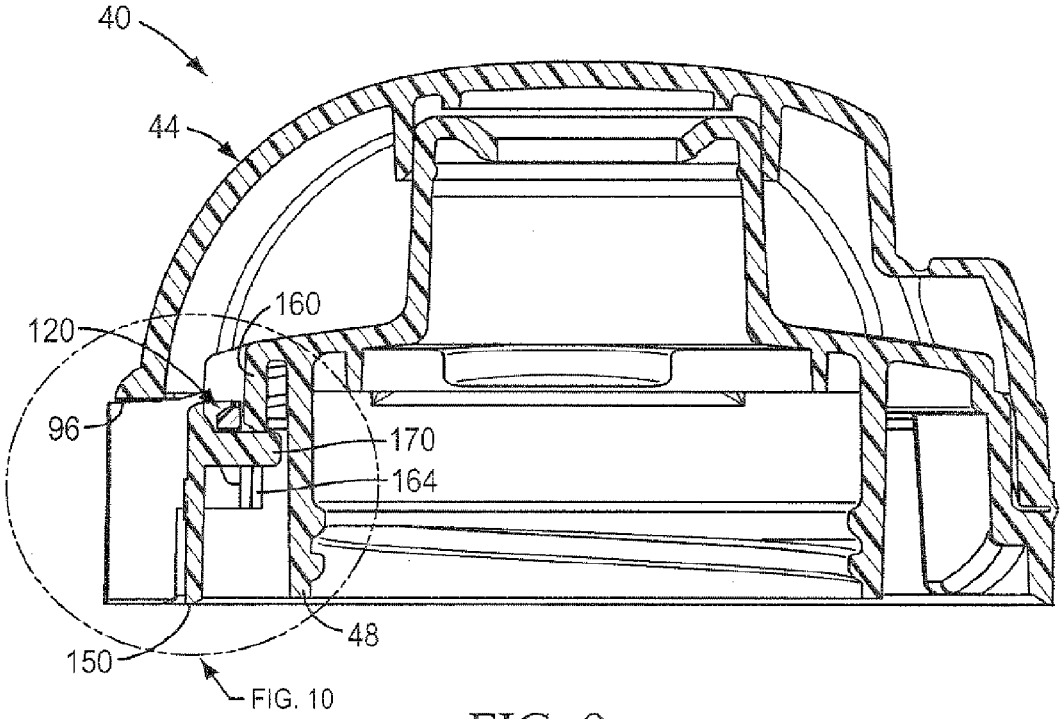
FIG. 9 is a cross-sectional view similar to FIG. 7, but FIG. 9 shows the closure after the pressing member has been pressed laterally inwardly for the first time by a user to deform to an actuated configuration and break the frangible junction between the lid and the tamper-evident tab.
Figure 10:
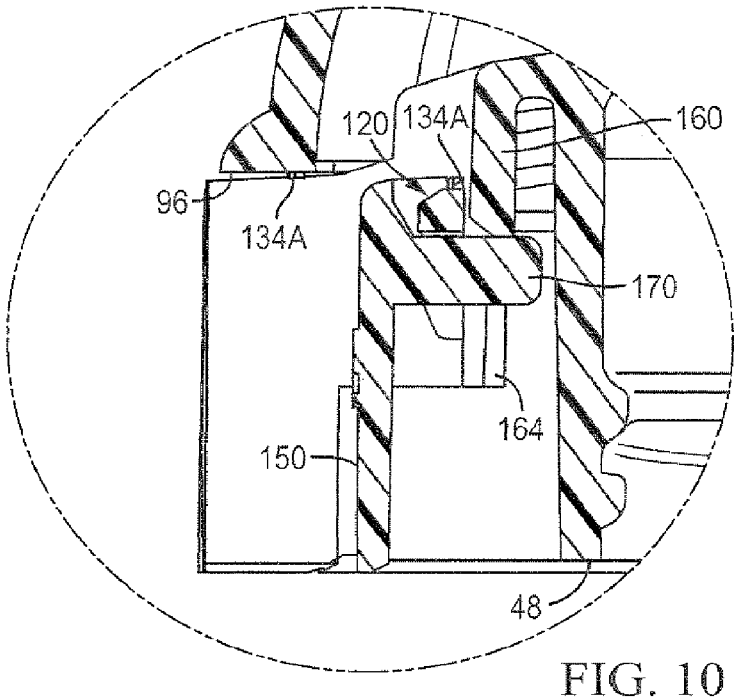
FIG. 10 is an enlarged cross-sectional view of the corner of the closure circumscribed by the circle labeled "FIG. 10" in FIG. 9.
Figure 11:
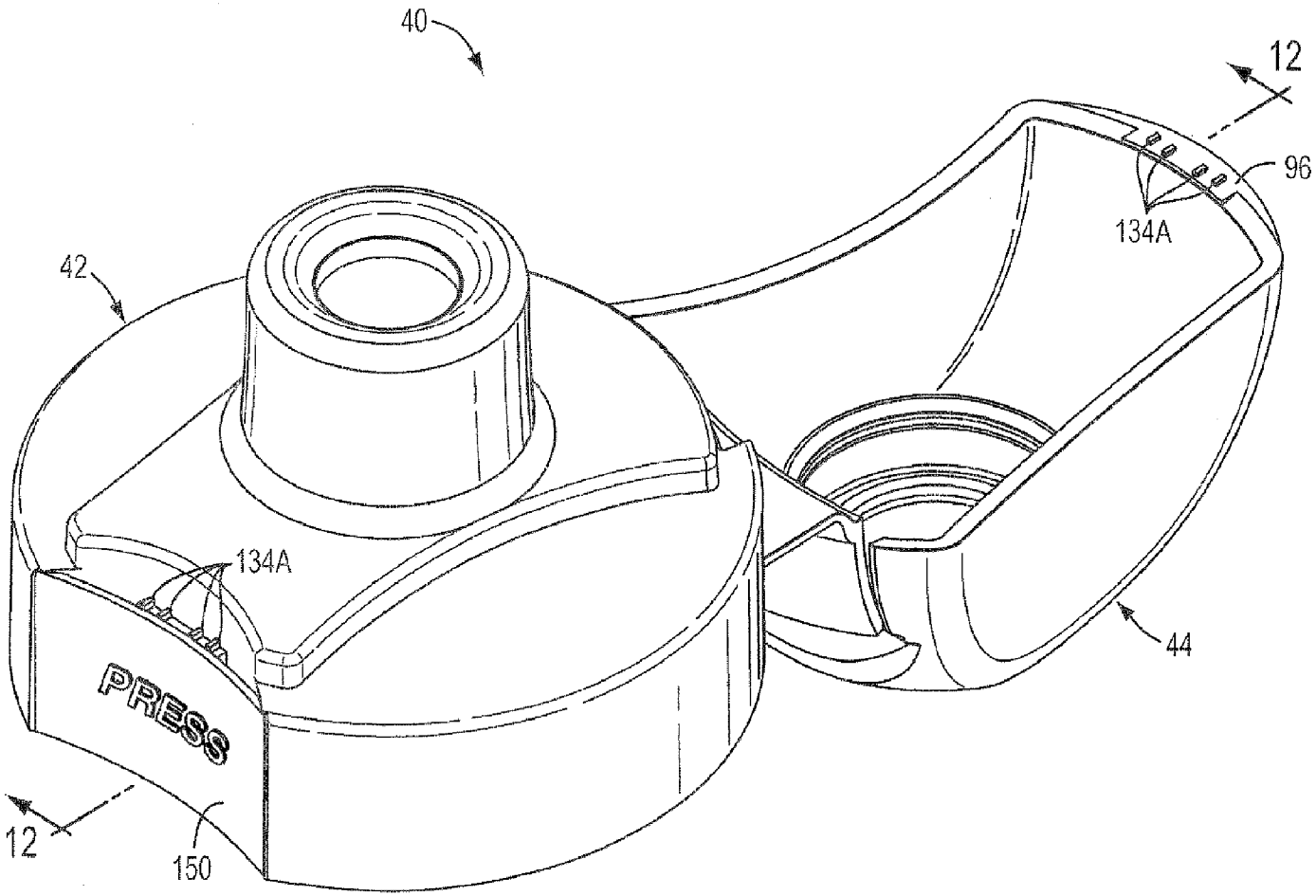
FIG. 11 is a top isometric view of the closure after the lid has been lifted from the closed condition shown in FIGS. 9 and 10 and moved to a fully opened position.
Figure 12:
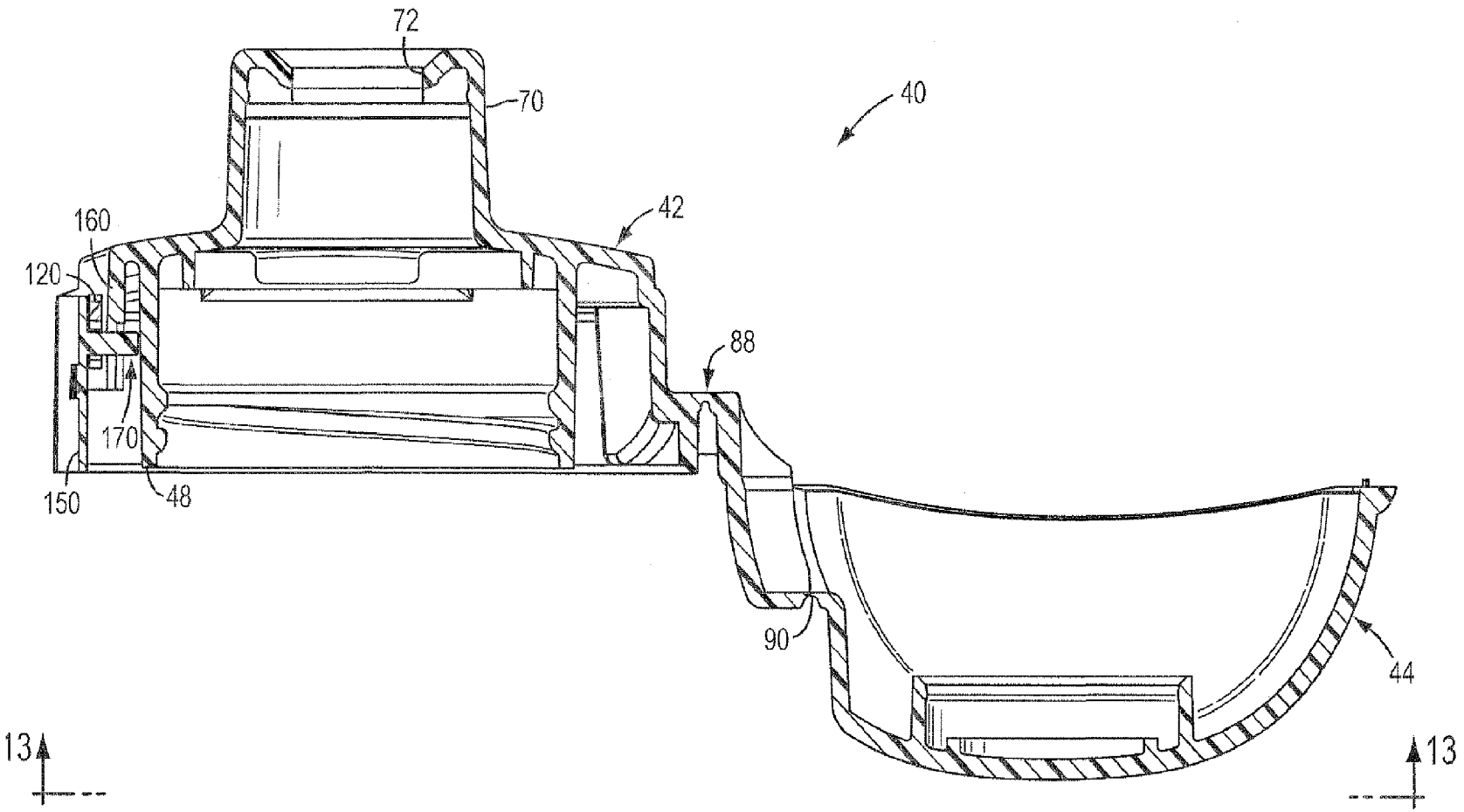
FIG. 12 is a cross-sectional view taken generally along the plane 12-12 in FIG. 11.
Figure 13:
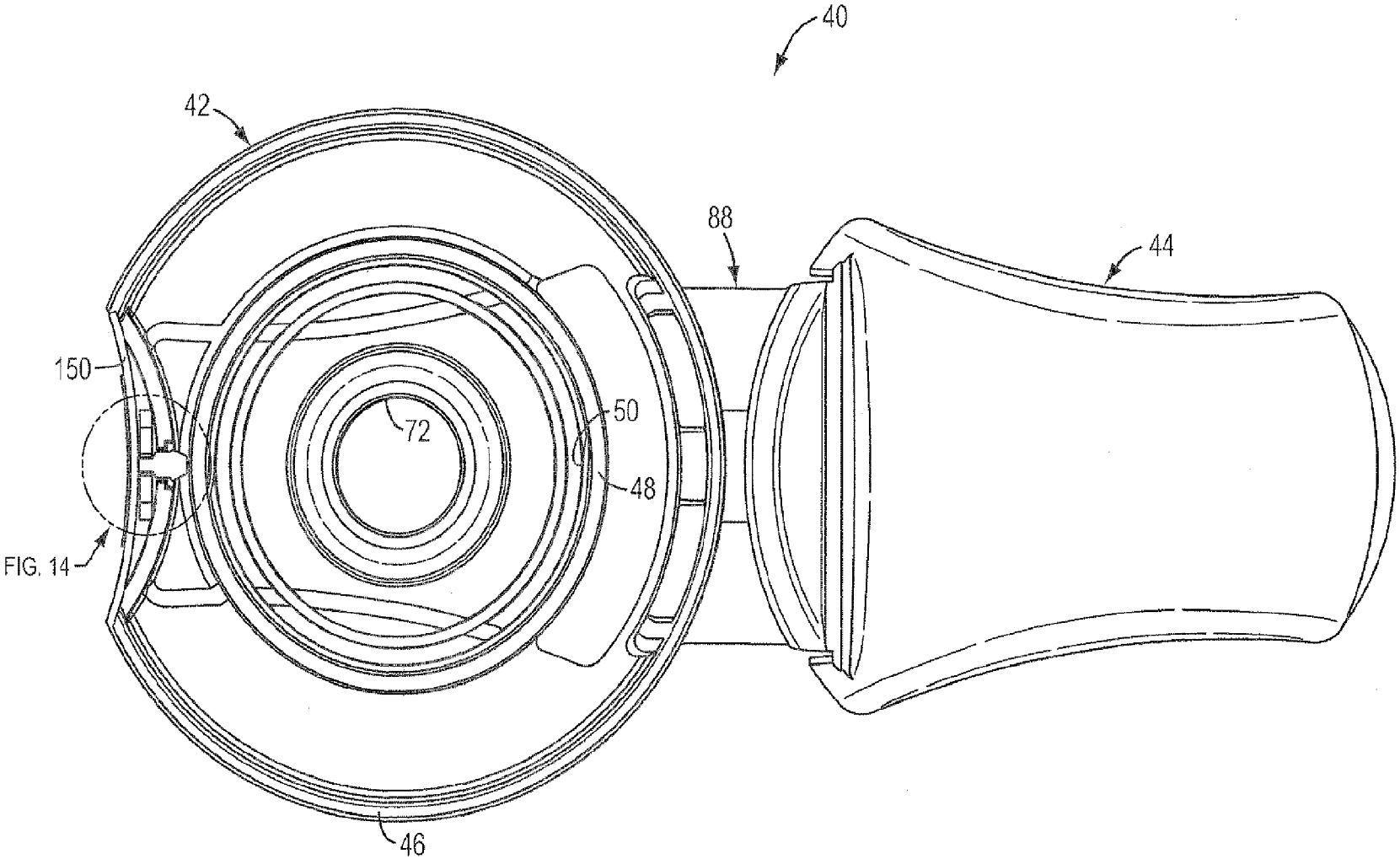
FIG. 13 is a bottom plan view taken generally along the plane 13-13 shown in FIG. 12.

With reference to FIG. 2, the closure body 42 includes a pressing member 150 that is located at the front of the closure body 42 (and below the front of the lid 44 when the lid 44 is closed). The pressing member 150 is joined or connected to the closure body 42 in an initial, unactuated configuration. The pressing member 150 can be subsequently pressed laterally inwardly (toward the hinge 88) to deform to an actuated configuration (FIGS. 9, 10, and 11). The pressing member 150 is connected to the closure body exterior skirt 46 along two vertical side edges 154 of the pressing member 150. Each vertical connection of the pressing member 150 along the side edge 154 to the closure body exterior skirt 46 is defined by a reduced cross-sectional thickness of material. The reduced cross section of material along each vertical side edge 154 functions as a flexible region or hinge which allows the pressing member 150 to be pressed laterally inwardly to deform to the actuated configuration (FIG. 11).

Figure 5:
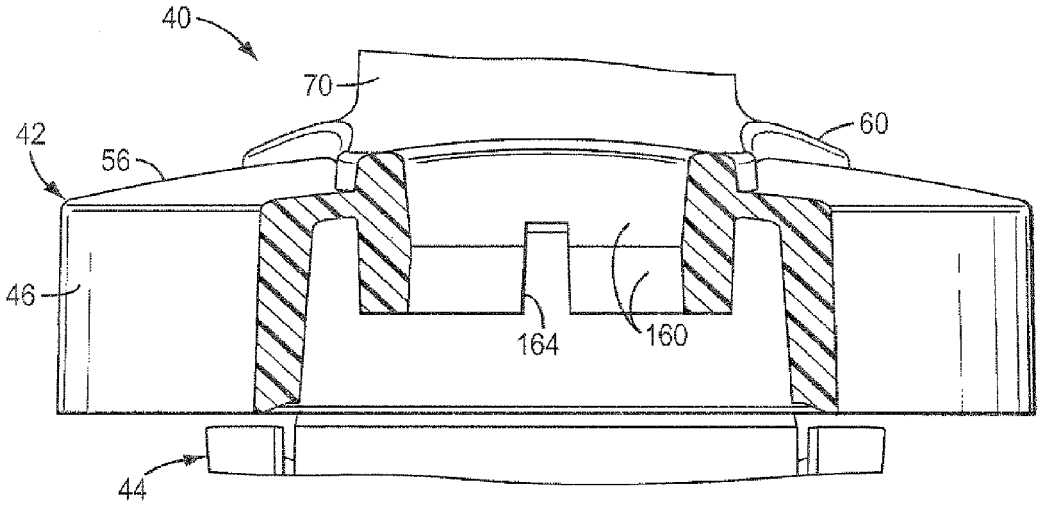
FIG. 5 is an enlarged, fragmentary, cross-sectional view taken generally along the plane 5-5 in FIG. 3.

As can be seen in FIGS. 2, 3, and 7, the closure body includes a retention wall 160 that is concave as viewed from the exterior of the closure body 42. As can be seen in FIG. 7, the retention wall 160 is located laterally exterior of the closure body collar 48. Further, as can be seen in FIGS. 2, 5, and 6, a central portion of the retention wall 160 defines an aperture 164. When the user first opens the lid 44 by manipulating the closure 40 as described in detail hereinafter, the retention wall 160 and its aperture 164 function as a "second receiver" to receive a portion of a post 170 (FIG. 8) that extends rearwardly from the inside surface of the pressing member 150.

Figure 8:
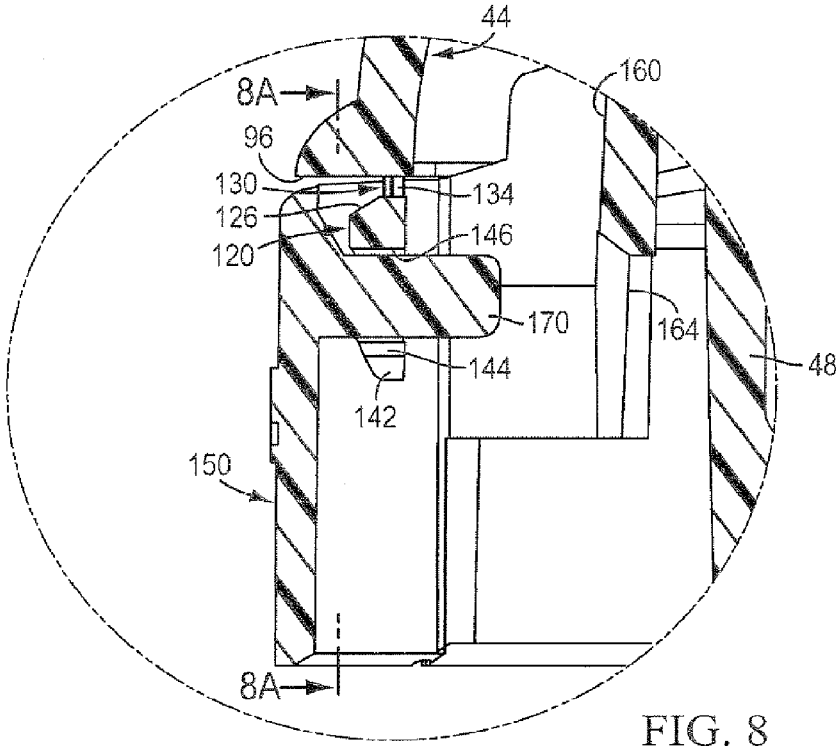
FIG. 8 is a greatly enlarged, fragmentary, cross-sectional view of the corner of the closure circumscribed by the circle labeled "FIG. 8" in FIG. 7.
Figure 8A:
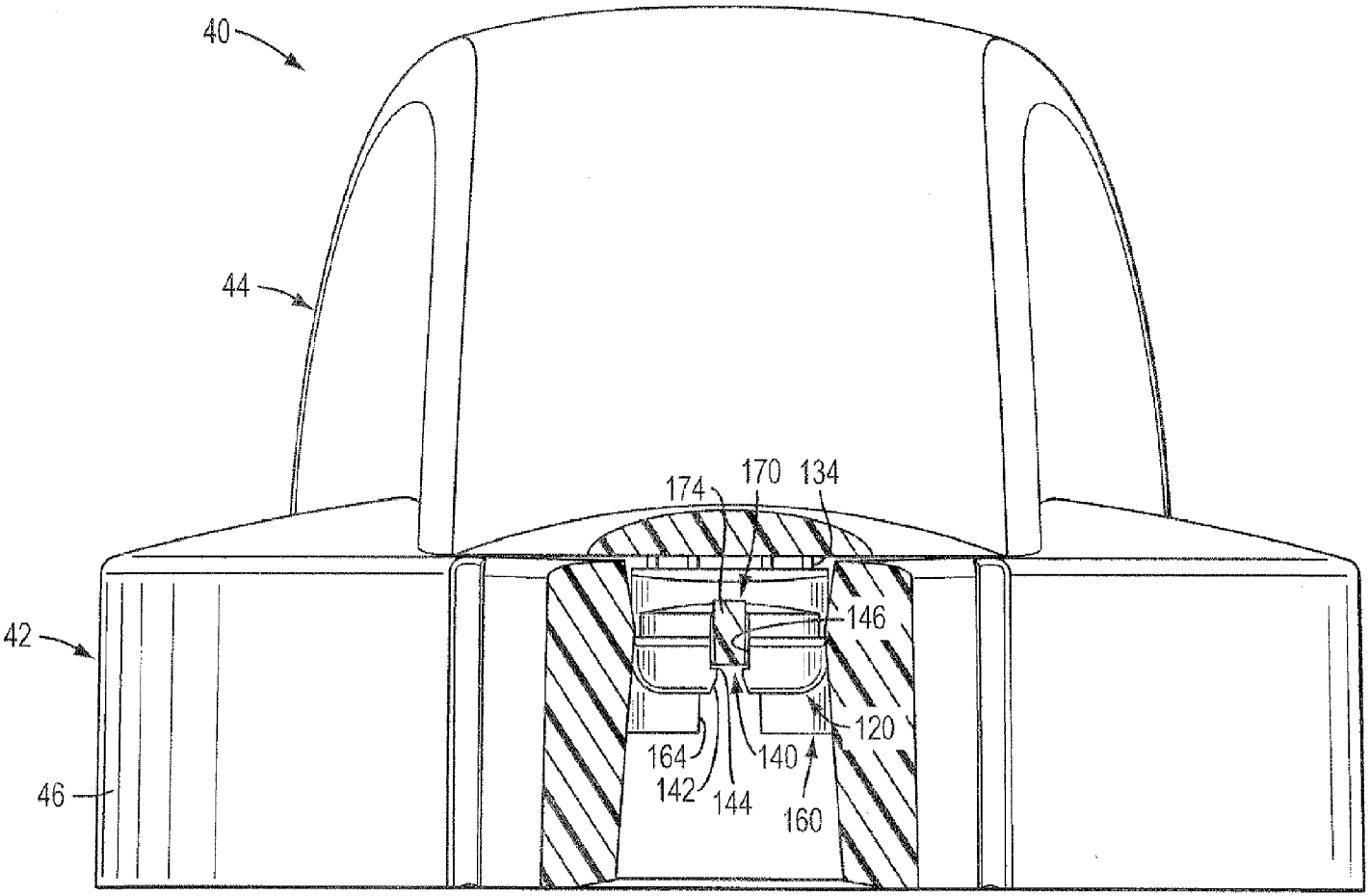
FIG. 8A is a fragmentary, cross-sectional view taken generally along the plane 8A-8A in FIG. 8.

The post 170 includes a shank 174 (FIG. 14) for being received in a non-releasable arrangement with the increased width recess 146 (FIG. 8) of the tab slot 140 (FIG. 2) when the lid 44 is initially moved to the closed position for the first time and forces the tab 120 onto the post shank 174 so as to position the post shank 174 in the tab slot increased width recess 146 (FIGS. 2, 8, and 8A). In the illustrated embodiment, the post shank 174 defines a generally rectangular cross section portion extending rearwardly from the pressing member 150.

Figure 14:
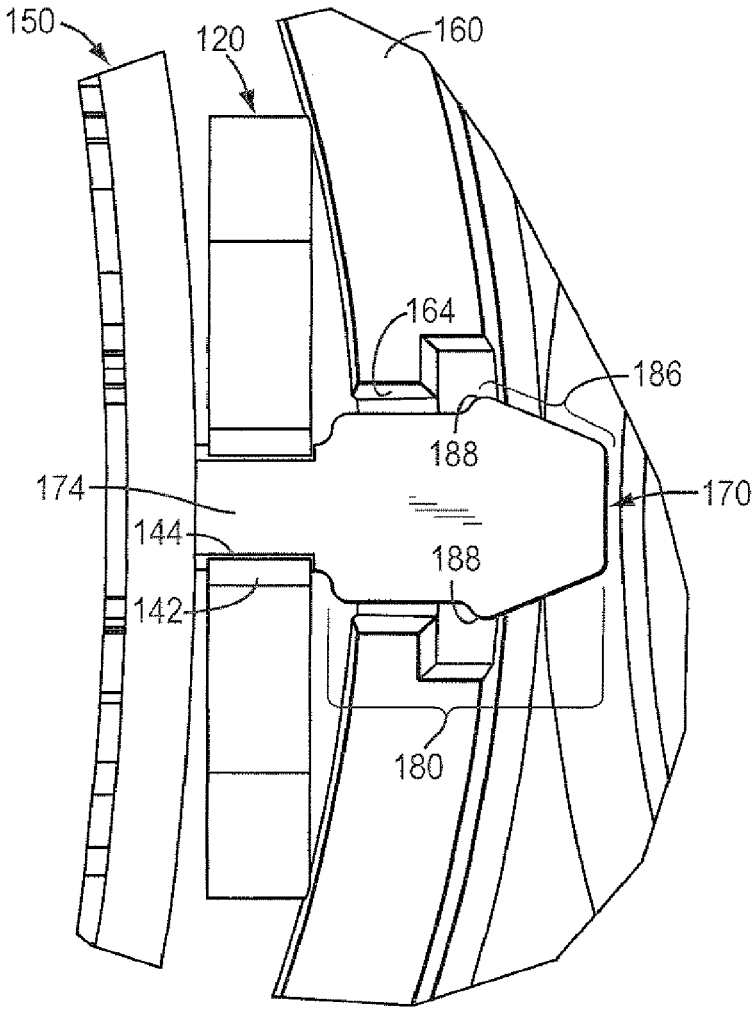
FIG. 14 is an enlarged, fragmentary, bottom plan view of the portion of the closure circumscribed by the circle labeled "FIG. 14" in FIG. 13.

As can be seen in FIG. 14, the post 170 also includes a head 180 that is located at the distal end of the post shank 174 and includes an enlarged retention portion 186. The enlarged retention portion 186 is defined by a pair of outwardly extending barbs 188 (FIG. 14). The barbs 188 decrease in size toward the distal end of the post 170 as can be seen in FIG. 14.

The closure 40 is initially molded by the manufacturer from a suitable polymeric material (such as, for example, polypropylene) with the lid 44 in a substantially fully opened position or orientation as illustrated in FIG. 2. After the closure 40 is released from the mold (not illustrated), the lid 44 is moved to the fully closed position (FIGS. 1, 7, and 8). As the front of the lid 44 moves downwardly against the closure body 42, the tab slot 140 (FIGS. 2 and 8A) is in vertical registry or alignment with the pressing member post 170. As can be seen in FIG. 8A, the outwardly tapering surfaces 142 at the bottom, distal end of the tab 120 can function as initial guides for facilitating downward movement of the tab 120 around the shank 174 of the post 170. The portions of the tab 120 at the slot minimum width location 144 can temporarily and elastically be spread apart around the shank 174 of the post 170 to accommodate the shank 174 being received within the increased width recess 146 toward the top of the tab 120. The tab 120 returns to its original, undeformed shape once the shank 174 of the post 170 has been received in the increased width recess 146 of the tab slot 140 so as to retain the post shank 174 in a snap-fit fashion in a non-releasable engagement.

The closed closure can be then installed on a suitable container filled with a product, and the completed package is then ready for use.

It will be appreciated that when the user first encounters the initially closed closure 40 with the pressing member 150 in the unactuated configuration (FIGS. 7 and 8), the frangible bridges 134 connect the closure lid 44 to the tamper-evident tab 120, and the tamper-evident tab 120 is sufficiently engaged around the post 170 to provide a sufficient restraint force that prevents disengagement of the tab 120 from the post 170 if the user initially tries to lift the lid 44 by pushing or pulling in an upward direction on surfaces of the lid 44.

In order to open the closure 40 on a container for the first time, the user must first press the pressing member 150 rearwardly or laterally inwardly (toward the hinge 88) against the tab 120 with sufficient force to break the frangible junction 130 (FIG. 6) defined by the frangible bridges 134 (FIG. 8). FIGS. 9 and 10 illustrate the condition of the closure 40 after the pressing member 150 has been pressed inwardly from the initial unactuated configuration shown in FIG. 1 to the deformed, actuated configuration. The frangible members 134 (shown unbroken in FIG. 8) are ruptured or broken, and leave small, broken stubs 134A (FIGS. 9 and 10) projecting downwardly from the lid 44 and/or upwardly from the proximal end of the tab 120.

When the pressing member 150 has been pushed rearwardly sufficiently far, the head 180 of the post 170, which is in alignment with the retention wall aperture 164, engages the edges of the retention wall 160 that define the aperture 164. The edges of the retention wall 160 defining the aperture 164 are temporarily and elastically deformed in such a way that they spread laterally further apart to accommodate insertion of the barbs 188 of the post head enlarged retention portion 186 as shown in FIG. 14. FIG. 14 shows some clearance around the post head 180 located within the retention wail aperture 164. This clearance can exist because the pressing member 150 has been deformed to its inwardly concave configuration, and that inwardly concave configuration is a self-maintained configuration owing to the stresses within the pressing wall 150. In the embodiment illustrated, the pressing wall 150 essentially buckles through a position of maximum stress as it is pushed or pressed inwardly from the unactuated convex configuration (FIGS. 1, 2, and 3) to the actuated concave configuration (FIG. 14). The stress in the pressing member 150 is at a maximum at some intermediate position between the unactuated configuration and the actuated configuration. This, in effect, is a bistable system wherein the pressing member 150 has (1) an initial, self-maintained convex, unactuated configuration wherein the stress is lower than the maximum stress at an intermediate configuration, and (2) a self-maintained concave, actuated configuration wherein the stress is lower than the maximum stress at the intermediate configuration.

If an attempt is made to move the deformed (i.e., actuated) pressing member 150 laterally forwardly (outwardly) away from the concave, actuated configuration illustrated in FIG. 14, then the barbs 188 on the enlarged retention portion 186 of the post 170 will engage the retention wall 160 on either side of the aperture 164 and prevent return of the pressing member 150 to the unactuated configuration. Thus, once the pressing member 150 has been initially pressed and moved to the actuated configuration for the first time, the pressing member 150 will remain locked in the actuated (concave) configuration thereafter as an indication that the frangible bridges 134 connecting the pressing member 150 to the lid 44 have been broken.

With the frangible bridges 134 broken and with the pressing member 150 maintained in the concave, actuated configuration, the user can readily apply a force with a finger or thumb to the lid lift region 96 (FIGS. 9 and 10) so as to lift the lid 44 upwardly, and then pivot the lid 44 to a fully open position (FIG. 11).

With reference to FIG. 8, it will be appreciated that the lid lifting region 96 is substantially inaccessible to the user because the lifting region 96 closely overlies the upper end of the pressing member 150 when the pressing member 150 is in the initial, unactuated configuration. Even if a user were to slide a thin tool between the lifting region 96 and the upper end of the pressing member 150 in an attempt to exert upward force on the lifting region 96, the unbroken frangible bridges 134 inhibit the lid 44 from being lifted upwardly. As can be seen in FIG. 8, the space between the lifting region 96 and the upper end of pressing member 150 substantially decreases rearwardly toward the frangible bridges 134, and that configuration makes it unlikely that the user could find a small tool and insert the tool sufficiently far inwardly to sever the frangible bridges 134.

When the pressing member 150 is initially pressed inwardly by the user to intentionally break the frangible bridges 134, the tamper-evident tab 120 remains engaged with the post 170 and does not drop away from the closure 40 as a waste piece which might litter the environment.

Because the pressing member 150 has an initial unactuated configuration that is highly visible, and also has a subsequently deformed, actuated configuration that is highly visible, a person can easily determine whether or not the package integrity has been violated.

Further, because the pressing member 150 is maintained or locked in the actuated position once the user has sufficiently pressed in on the pressing member 150 and then subsequently released the pressing force, the actuated pressing member 150 continues to provide the tamper-evident function.

Referring to FIG. 14, which shows the pressing member 150 in the fully actuated condition, it can be seen that the barbs 188 do not necessarily have to engage the retention wall 160 at the aperture 164 in order for the pressing member 150 to be maintained in the inwardly concave, actuated configuration. However, if an attempt were made to pull the pressing member 150 outwardly, the barbs 188 on the post 170 would engage retention wall 160 around the edges of the aperture 164 so as to prevent any significant outward movement of the pressing 150 toward the initial, unactuated configuration.

It will be appreciated that although the illustrated embodiment incorporates a pressing member 150 with a bi-stable action so that the pressing member 150 is self-maintained in the inwardly concave, actuated condition, the closure could be instead constructed in a way that does not require the pressing member 150 to have such a bi-stable, self-maintained, actuated configuration. For example, in an alternate embodiment (not illustrated), the thickness and initial curvature of the pressing member 150 could be designed, in conjunction with the vertical, lateral side edges (defined approximately at the locations 154 in FIG. 2), so that the pressing member 150 would not be a bi-stable member and would therefore not have a self-maintained, actuated configuration. Rather, in such an alternate design, the post 170 could engage the retention wall 160 at the aperture 164 in a manner that would function as the sole means for holding the pressing member 150 in an inwardly displaced, actuated configuration. In such an alternate embodiment, if the post 170 employed the barbs 188 (as shown in FIG. 14), then the engagement of the barbs 188 with the edges of the retention wall aperture 164 would be the sole means for preventing movement of the pressing member 150 away from the actuated configuration.

It will be appreciated that in the embodiment illustrated in FIG. 1, the pressing member 150 is readily visible to the user at the front of the closure 40. Moreover, when the closure lid 44 is initially closed by the manufacturer (FIGS. 1 and 7), the front of the closure lid 44 and body 42 advantageously lack outwardly extending protrusions that could interfere with handling, packaging, shipping, etc. Suitable instructions (such as the word "PRESS") and/or other indicia can be provided on the front surface on the pressing member 150 so as to present a visual feature which makes it easy for the user to understand how the closure 40 should be opened, and so as to present a visually intuitive feature that makes it easy for the user to determine if the package integrity has been violated.

In the illustrated embodiment, the inward movement of the pressing member 150 to the inwardly concave, actuated configuration results in the pressing member 150 substantially conforming to the inwardly extending recess defined by the concave retention wall 160, and this creates a large space under the lid lifting region 96 that allows the lid 44 to be easily opened, and this also readily provides an enhanced visual indication that the frangible bridges 134 have been broken and that the closure lid 44 can now be lifted open. However, in an alternate embodiment (not illustrated), the pressing member 150 need not necessarily assume a concave shape when pushed to the actuated configuration. It would be sufficient that the actuated pressing member 150 is held inwardly only far enough to provide (1) access to the lifting region 96, and (2) a view of the broken bridges 134A.

The provision of the pressing member 150 in the closure body 42 allows the manufacturer to initially place the closure in a "ready-to-open" configuration for user manipulation that (1) requires only a simple pushing action to permit lifting of the lid 44, and (2) does not require other, more complicated, manipulations, such as rotating and/or pulling a component relative to another component.

In the embodiment illustrated, the tamper-evident tab 120 with its slot 140 functions as a "first receiver" for receiving the post shank 174 in a non-releasable arrangement, whereas the retention wall 160 with its aperture 164 functions as a "second receiver" for receiving a portion of the post head 180 in a non-releasable arrangement. The post shank 174 may be characterized as a "first connector" for being received in the first receiver tab slot 140 in a non-releasable arrangement. Moreover, the post shank 174 together with the enlarged retention portion 186 of the head 180 may be characterized as a "second connector" that is defined on the first connector and that can be positioned in a non-releasable arrangement with the aperture 164 of the retention wall 160 which together define the second receiver.

It will be appreciated that in an alternate embodiment (not illustrated), the closure 40 could have a different configuration wherein the connector post is on the tamper-evident tab (in place of the slot 140) to function as both the "first connector" and "second connector," and wherein the pressing member has a snap-fit slot (in place of the post 170) to function as a "first receiver" for receiving the post (wherein the enlarged head end of the post would still continue to function as part of the second connector for being retained in the retention wall aperture 164 as in the illustrated embodiment).

It will also be appreciated that the shapes of the frangible bridges 134, side edge connections 154 of the pressing member 150, various wall sections, distances, and tolerances could be altered to adapt to varying sizes and styles of closures.

With reference to the spout 70 illustrated in FIG. 7, the spout 70 is adapted to receive an optional pressure-actuatable, slit valve (not shown) that can be maintained in place adjacent the spout orifice 72 with a suitable snap-in valve retainer member (not shown) wherein such a valve retainer member can be maintained in a snap-fit engagement with an internal annular snap-fit bead 73 on the inside of the spout 70 in such a way that the valve retainer member clamps the periphery of the valve against the upper end of the spout 70 around the spout orifice 72 and in such a way that the valve slit or slits are aligned with the spout orifice 72. One such conventional valve that may be employed with the closure 40 is the valve that is illustrated and described in the U.S. Pat. No. 7,117,654, wherein the valve is designated generally therein by the reference number 60. The closure of the present invention may be used with or without a valve, and the detailed design and operation of such a valve form no part of the present invention.

It will be readily observed from the foregoing detailed description of the invention and from the illustrations thereof that numerous other variations and modifications may be effected without departing from the true spirit and scope of the novel concepts or the principles of this invention.

What is claimed is:

1. A closure for a container that has an opening to the container interior where a product may be stored, said closure comprising:

(A) a body that is either (a) a separate structure for being attached to said container at said opening or (b) a structure formed as a unitary portion of said container at said opening, said body having at least one dispensing orifice for communicating with said container opening;

(B) a lid that (1) is connected to said body with a hinge and movable between (i) a closed position occluding said dispensing orifice, and (ii) an open position spaced from said dispensing orifice, and (2) has a lifting region against which a force can be applied by the user to lift said lid away from said closed position;

(C) a tamper-evident tab that has a proximal end frangibly connected to said lid with a frangible junction; and (D) a pressing member that (1) is connected to said body in an initial unactuated configuration, and (2) can be subsequently pressed laterally inwardly to (i) deform to an actuated configuration, and (ii) force said tamper-evident tab laterally inwardly a distance sufficient to break said frangible junction to separate said tamper-evident tab from said lid; and wherein a first receiver is defined on one of said tamper-evident tab and said pressing member;

a first connector is defined on the other of said tamper-evident tab and said pressing member for being received in said first receiver to establish a non-releasable arrangement between said tamper-evident tab and said pressing member when said lid is initially moved to said closed position for the first time;

a second receiver is defined on said body; and a second connector is defined on said first connector for being received by said second receiver when said pressing member is pressed laterally inwardly from said unactuated configuration to said actuated configuration to establish a non-releasable arrangement between said pressing member and said second receiver while said pressing member is in said actuated configuration to indicate that said tamper-evident tab has been broken.

2. The closure in accordance with claim 1 in which said first receiver includes a slot that is (1) defined in said tab, and (2) open downwardly to the distal end of said tab when said lid is in said closed position on the closure body on top of an upright container wherein part of said slot defines an increased width recess at a location upwardly from the distal end of said tab;

said pressing member includes a post that (1) extends laterally inwardly, (2) includes (a) a shank defining said first connector for being received in a non-releasable arrangement in said tab slot when said lid is initially moved to said closed position for the first time and forces said tab onto said post shank so as to position said shank in said increased width recess of said tab slot, and (b) a head that (i) is located adjacent the distal end of said post shank, and (ii) includes an enlarged retention portion that together with said shank defines said second connector; and said second receiver includes a retention wall that is located on said body and that defines an aperture for accommodating the forcing of said post head enlarged retention portion therethrough when a user presses said pressing member laterally inwardly from said initial unactuated configuration to said actuated configuration so as to (a) separate said tamper-evident tab from said lid by breaking said frangible junction to thereby permit lifting of said lid to said open position, and (b) move said post to locate said post head enlarged retention portion laterally inwardly beyond said retention wall aperture to establish a non-releasable arrangement with said retention wall.

3. The closure in accordance with claim 2 in which said closure body includes (1) an exterior skirt, and (2) an interior collar for engaging an upper end of said container around said container opening; and said retention wall is laterally exterior of said closure body interior collar and is concave as viewed from the exterior of said closure body.

4. The closure in accordance with claim 3 in which said pressing member is located laterally outwardly of said retention wall and is connected to said closure body exterior skirt along two vertical side edges of said pressing member wherein each said connection of said pressing member along one of said vertical side edges to said closure body exterior skirt is defined by a reduced cross-sectional thickness of material.

5. The closure in accordance with claim 4 in which said pressing member has (1) an initial convex shape in said initial unactuated configuration as viewed from the exterior of said closure body, and (2) a concave shape in said actuated configuration when viewed from the exterior of said closure body.

6. The closure in accordance with claim 2 in which said enlarged retention portion of said pressing member post head includes a pair of outwardly extending barbs which together define said enlarged retention portion and which each decreases in size toward the distal end of said post; and said retention wall is sufficiently resilient so as to temporarily, elastically deform to accommodate passage of said pressing member post head enlarged retention portion through said aperture.

7. The closure in accordance with claim 2 in which the width of said slot decreases from the distal end of said tamper-evident tab to a minimum width leading to said increased width recess; and said post shank includes a generally rectangular portion which (1) has a thickness greater than said tab slot minimum width, and (2) can be received in said increased width recess of said tab slot when said tab is forced downwardly against said post shank rectangular portion whereby said tab is sufficiently resilient so as to be temporarily, elastically deformed to temporarily increase said minimum width of said slot so that said post shank rectangular portion is received in said increased width recess of said slot after which said tab assumes a less deformed configuration to create a non-releasable arrangement.

8. The closure in accordance with claim 1 in which said closure is a separately manufactured component that can be subsequently attached to said container around said opening of said container.

9. The closure in accordance with claim 1 in which said pressing member is configured to (1) undergo elastic deformation from a convex shape to a concave shape when pressed by the user laterally inwardly toward said actuated configuration, and (2) be free to return to said initial unactuated configuration if the user releases the pressing force on said pressing member prior to said pressing member elastically deforming out of said convex shape.

10. A closure for a container that has an opening to the container interior where a product may be stored, said closure comprising:

(A) a body that is either (a) a separate structure for being attached to said container at said opening or (b) a structure formed as a unitary portion of said container at said opening, said body dispensing having at least one dispensing orifice for communicating with said container opening;

(B) a lid that (1) is connected with a hinge to said body and movable between (i) a closed position occluding said dispensing orifice, and (ii) an open position spaced from said dispensing orifice, and (2) has a lifting region against which a force can be applied by the user to lift said lid away from said closed position;

(C) a tamper-evident tab that (1) has a proximal end frangibly connected to said lid with a frangible junction, and (2) defines a slot that is open downwardly to the distal end of said tab when said lid is in said closed position on the closure body on top of an upright container wherein part of said slot defines an increased width recess at a location upwardly from the distal end of said tab; and (D) a pressing member that (1) is connected to said body in an initial unactuated configuration, (2) can be subsequently pressed laterally inwardly to (i) deform to an actuated configuration, and (ii) force said tamper-evident tab laterally inwardly a distance sufficient to break said frangible junction to separate said tamper-evident tab from said lid, and (3) has a laterally inwardly projecting post that includes (a) a shank for being received in a non-releasable arrangement in said tab slot when said lid is initially moved to said closed position for the first time and forces said tab onto said post shank so as to position said post shank in said increased width recess of said tab slot, and (b) a head that (i) is located adjacent the distal end of said post shank, and (ii) includes an enlarged retention portion; and wherein said body further includes a retention wall defining an aperture for accommodating the forcing of said post head enlarged retention portion therethrough when a user presses said pressing member laterally inwardly from said initial unactuated configuration to said actuated configuration so as to (a) separate said tamper-evident tab from said lid by breaking said frangible junction to thereby permit lifting of said lid to said open position, and (b) move said post to locate said post head enlarged retention portion laterally inwardly beyond said retention wall aperture to establish a non-releasable arrangement with said retention wall while said pressing member is in said actuated configuration to indicate that said tab has been broken from said lid.

11. The closure in accordance with claim 10 in which said closure is a separately manufactured component that can be subsequently attached to said container around said opening of said container.

12. The closure in accordance with claim 10 in which said closure body includes (1) an exterior skirt, and (2) an interior collar for engaging an upper end of said container around said container opening;

said retention wall is laterally exterior of said closure body interior collar and is concave as viewed from the exterior of said closure body;

said pressing member is located laterally outwardly of said retention wall and is connected to said closure body skirt along two vertical side edges of said pressing member wherein each said connection of said pressing member along one of said vertical side edges to said closure body skirt is defined by a reduced cross-sectional thickness of material;

said pressing member has (1) an initial convex shape in said initial unactuated configuration as viewed from the exterior of said closure body, and (2) a concave shape in said actuated configuration when viewed from the exterior of said closure body;

said pressing member is configured to (1) undergo elastic deformation from a convex shape to a concave shape when pressed by the user laterally inwardly toward said actuated configuration, and (2) be free to return to said initial unactuated configuration if the user releases the pressing force on said pressing member prior to said pressing member (150) elastically deforming out of said convex shape;

said enlarged retention portion of said pressing member post head includes a pair of outwardly extending barbs which together define said enlarged retention portion and which each decreases in size toward the distal end of said post; and said retention wall is sufficiently resilient so as to temporarily, elastically deform to accommodate passage of said pressing member post head enlarged retention portion through said aperture.

13. The closure in accordance with claim 10 in which said frangible junction connecting said tamper-evident tab to said lid is defined by a reduced cross-sectional thickness of material.

14. The closure in accordance with claim 10 in which said lifting region of said lid is located generally 180 degrees from said hinge that connects said lid to said body.

15. The closure in accordance with claim 10 in which the width of said slot decreases from the distal end of said tamper-evident tab to a minimum width leading to said increased width recess; and said post shank includes a generally rectangular portion which (1) has a thickness greater than said tab slot minimum width, and (2) can be received in said increased width recess of said tab slot when said tab is forced downwardly against said post shank rectangular portion whereby said tab is sufficiently resilient so as to be temporarily, elastically deformed to temporarily increase said minimum width of said slot so that said post shank rectangular portion is received in said increased width recess of said slot after which said tab assumes a less deformed configuration to create a non-releasable arrangement.

* * * * *

UNITED STATES PATENT AND TRADEMARK OFFICE

CERTIFICATE OF CORRECTION

PATENT NO. : 8,413,832 B2
APPLICATION NO. : 13/262911
DATED : April 9, 2013
INVENTOR(S) : Timothy M. Mazurkiewicz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 34 days.

In the Claims:

Column 12, line 32, “body dispensing” should be --body--.

Signed and Sealed this
Seventeenth Day of September, 2013

Teresa Stanek Rea
*Deputy Director of the United States Patent and Trademark Office*